US011002042B2

(12) United States Patent
Moore

(10) Patent No.: US 11,002,042 B2
(45) Date of Patent: May 11, 2021

(54) SAFETY DOOR LATCH SYSTEM

(71) Applicant: Jamell E. Moore, Tacoma, WA (US)

(72) Inventor: Jamell E. Moore, Tacoma, WA (US)

( * ) Notice: Subject to any disclaimer, the term of this patent is extended or adjusted under 35 U.S.C. 154(b) by 2 days.

(21) Appl. No.: 16/735,360

(22) Filed: Jan. 6, 2020

(65) Prior Publication Data

US 2020/0165842 A1 May 28, 2020

Related U.S. Application Data

(63) Continuation-in-part of application No. 15/438,615, filed on Feb. 21, 2017, now abandoned.

(60) Provisional application No. 62/375,860, filed on Aug. 16, 2016.

(51) Int. Cl.

| | |
|---|---|
| ***E05B 13/00*** | (2006.01) |
| ***E05B 37/16*** | (2006.01) |
| ***E05B 65/00*** | (2006.01) |

(52) U.S. Cl.

CPC ..... *E05B 65/0014* (2013.01); *E05B 13/002* (2013.01); *E05B 37/16* (2013.01)

(58) Field of Classification Search

None

See application file for complete search history.

(56) References Cited

U.S. PATENT DOCUMENTS

| | | | | |
|---|---|---|---|---|
| 876,300 | A | 1/1908 | Couret | |
| 925,455 | A | 6/1909 | Campbell | |
| 1,369,820 | A | 6/1909 | Krizs | |
| 1,531,605 | A | 3/1925 | Gaynor | |
| 1,571,453 | A | 2/1926 | Maxon | |
| 2,164,148 | A * | 6/1939 | Swanson | A45C 11/32 362/203 |
| 2,164,149 | A | 6/1939 | Swanson | |
| 4,109,494 | A | 8/1978 | Allemann | |
| 4,546,628 | A | 10/1985 | Takasaki | |
| 5,346,266 | A | 9/1994 | Bisbing | |
| 5,772,191 | A * | 6/1998 | Nakano | F16F 1/122 267/179 |

(Continued)

FOREIGN PATENT DOCUMENTS

| | | | | |
|---|---|---|---|---|
| CH | 203907 | * | 4/1939 | E05C 3/30 |

OTHER PUBLICATIONS

Author unknown, "Hot Halfmoon push lock Keyless Push Latch Catch RV Wardrobe drawer ambry boat motorhome caravan cupboard funiture lock," http://www.aliexpress.com/store/product/hot-half-moon-push-lock-keyless-push-latch-catch-rv-vardrobe-drawer-cabinet-embry-boat-motorhome/1351108_32651903031.html. accessed Jul. 22, 2016.

(Continued)

*Primary Examiner* — Kristina R Fulton
*Assistant Examiner* — Thomas L Neubauer
(74) *Attorney, Agent, or Firm* — George A. Leone

(57) ABSTRACT

A child safety door latch system includes interchangeable pushbutton compression springs of varying tensions proportional to selected values of thumb opposition strength. A pair is selected for a predetermined age group. A pair of handles each contain one of the selected pair of compression springs and a pushbutton. A latch includes a latch compression spring and a latch slider. A master connector is coupled to the latch slider. In a locked mode, the selected pair of compression springs cooperate with the latch compression spring such that the latch protrudes from the latch sleeve, holding the door locked.

2 Claims, 7 Drawing Sheets

(56) References Cited

U.S. PATENT DOCUMENTS

| | | | | |
|---|---|---|---|---|
| 6,454,320 | B1 | 9/2002 | Weinerman et al. | |
| 6,981,724 | B2 | 1/2006 | Denys | |
| 9,051,758 | B2 | 6/2015 | Cuddy et al. | |
| 2012/0211999 | A1* | 8/2012 | VanHellemont | E05C 1/06 292/58 |
| 2013/0175811 | A1* | 7/2013 | Hodgin | E05B 3/08 292/164 |
| 2015/0048629 | A1 | 2/2015 | Hogan | |

OTHER PUBLICATIONS

U.S. Appl. No. 15/438,615, "Non-Final Office Action," dated Oct. 4, 2019.

* cited by examiner

SAFETY DOOR LATCH SYSTEM

RELATED APPLICATIONS

This is a nonprovisional application that claims priority from co-pending U.S. non-provisional application Ser. No. 15/438,615 filed Feb. 21, 2017 which claimed the priority of U.S. provisional application Ser. No. 62/375,860, having filing date Aug. 16, 2016, both entitled "Safety Door Latch," in both of which are incorporated herein by reference.

TECHNICAL FIELD

The present invention relates to safety door latches. More particularly, the invention relates to a built-in child safety door latch system for use in domestic dwellings.

BACKGROUND

The US Consumer Products Safety Commission (CPSC) reports that each year, children are injured by hazards in and around the home. On its website (CPSC.gov), it advocates the use of door knob covers and door locks to help prevent children from entering rooms and other areas with possible dangers. Door knob covers and door locks can help keep children away from places with hazards. The CPSC recommends that the door knob cover chosen is sturdy, and allows a door to be opened quickly by an adult in case of emergency.

As noted above, currently available child safety door knob products are made to cover a conventional door knob. Typically, such safety are not products are undesirable from an aesthetic viewpoint. They are typically made from plastic and their purpose is quite obvious, even to a child.

While child safety is paramount in a family home, most homeowners also go to great care in selecting decor that is attractive and matches throughout the home. Thus, there is a need for an attractive built in door child safety latch that provides security while maintaining an attractive appearance. The instant invention has responded to this need by providing a novel built in safety door latch system having interchangeable compression springs with tensions proportional to thumb strengths of different age groups.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

A child safety door latch system is disclosed including a set of interchangeable pushbutton compression springs, including compression springs of varying tensions, wherein the varying tensions are proportional to selected values of thumb strength. A pair of compression springs is selected for a predetermined age group from the set of interchangeable pushbutton compression springs. A set of pushbuttons each includes a threaded inner channel. A pair of inner shaft buttons includes a threaded end portion for threading on to one of the pushbutton threaded inner channels and capturing one of the selected pair within one of the inner shaft buttons. A plurality of connectors, a latch slider and a latch compression spring are also part of the system. A pair of handles where each handle includes a first channel sized to contain one of the selected pair of compression springs and the pushbutton, each handle also includes a second channel, aligned with the first channel, sized to allow insertion of one of the pair inner shaft buttons at the threaded end portion, where one of the selected pair of compression springs is captured in a different one of the pair of handles, between a one of the pair inner shaft buttons at the threaded end and one of the pushbuttons. Further, each handle includes mounting devices to allow mounting onto a doorframe. A latch includes a first channel sized to receive the latch compression spring and the latch slider. A master connector includes a pair of opposing linear edges, where the master connector is coupled at a first end to the plurality of connectors and at a second end to the latch slider, and the plurality of connectors is angled inwardly to form an acute angle with respect to the linear edges of the master connector. In a locked mode, the selected pair of compression springs cooperate with the latch compression spring such that the latch protrudes from the latch sleeve, holding the door locked.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
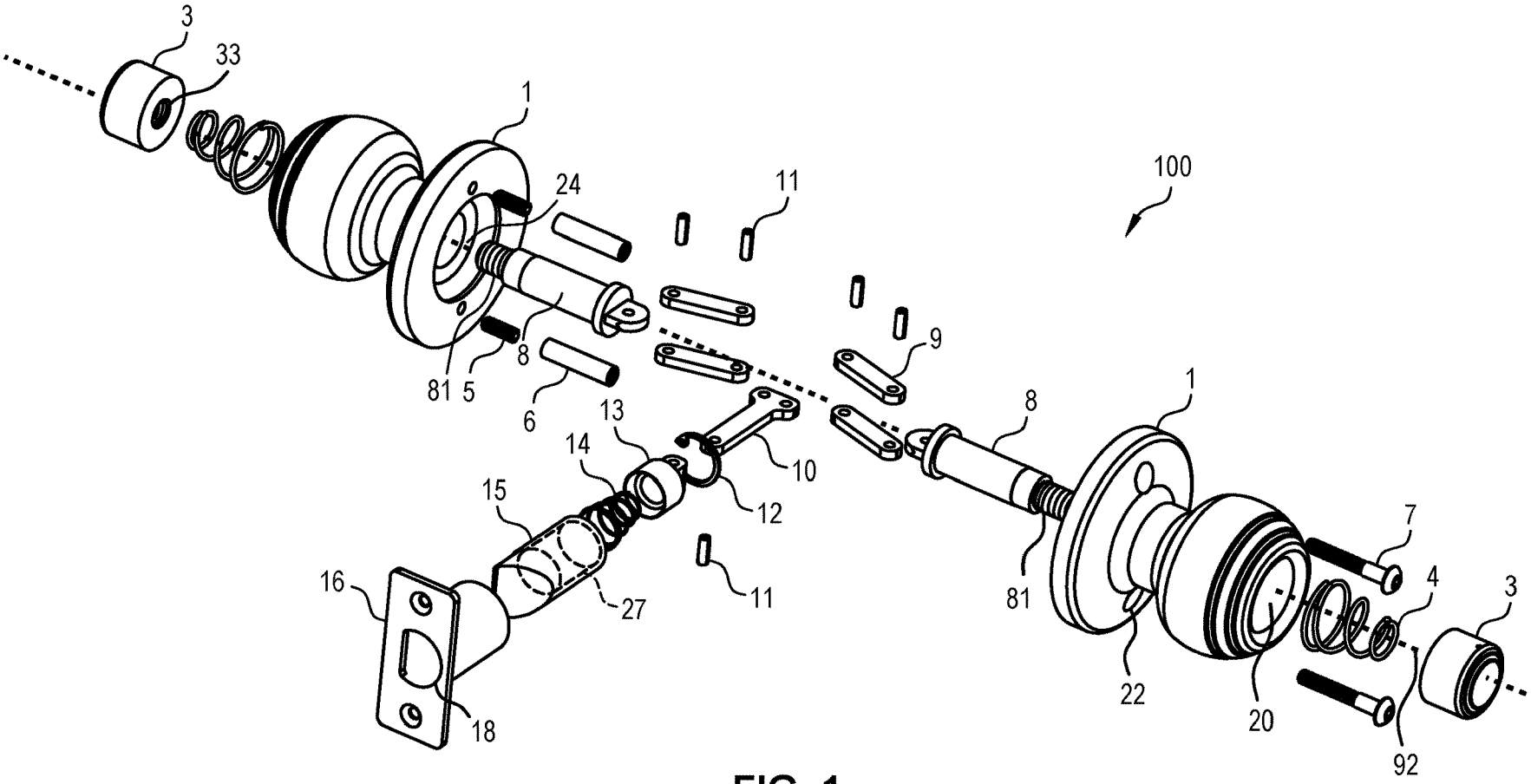
FIG. 1 schematically shows an exploded view of the components used in one example of a safety door latch system.

In the drawings, identical reference numbers call out similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not necessarily intended to convey any information regarding the actual shape of the particular elements and have been solely selected for ease of recognition in the drawings.

DETAILED DESCRIPTION OF THE PREFERRED EMBODIMENTS

The following disclosure describes a safety door latch system. Several features of methods and systems in accordance with example embodiments are set forth and described in the figures. It will be appreciated that methods and systems in accordance with other example embodiments can include additional procedures or features different than those shown in the figures. Example embodiments are described herein with respect to a built-in child safety door latch. However, it will be understood that these examples are for the purpose of illustrating the principles, and that the invention is not so limited.

Definitions

Generally, as used herein, the following terms have the following meanings, unless the use in context dictates otherwise:

The use of the word "a" or "an" when used in conjunction with the term "comprising" in the claims or the specification means one or more than one, unless the context dictates otherwise. The term "about" means the stated value plus or minus the margin of error of measurement or plus or minus 10% if no method of measurement is indicated. The use of the term "or" in the claims is used to mean "and/or" unless explicitly indicated to refer to alternatives only or if the alternatives are mutually exclusive. The terms "comprise", "have", "include" and "contain" (and their variants) are open-ended linking verbs and allow the addition of other elements when used in a claim.

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

"Mechanically coupled," as used herein means physically linked through one or more linking components to another mechanical component in order to transfer forces, movement or the like.

An advantage of the safety door latch disclosed herein is inherent in its operation. The instant product is designed for child safety and, in one example, features a push button release on both sides of the door that a child will not be strong enough to operate. Using the instant safety door latch, a door will not open unless force is applied to release the latch while simultaneously pushing or pulling on a handle to open the door. Most interior doors open into the room in a home. The instant safety door latch requires someone to push the release button and push or pull the door open simultaneously creating a more complex situation for a child to act out.

Referring to FIG. 1, an exploded view of the components used in one example of a safety door latch is schematically shown. A child safety door latch 100 includes a pair of handles 1, a set of pushbuttons 3, a set of compression springs 4, a plurality of setscrews 5, a plurality of female threaded rods 6, a plurality of button head cap screws 7, a pair of inner shaft buttons 8, a plurality of connectors 9, a master connector 10, a plurality of coiled spring pins 11, a retaining ring 12, a latch slider 13, a latch compression spring 14, a latch 15 and a latch sleeve 16. Each of the handles 1 may, in one advantageous example, be made of a solid material such as nylon, plastic, metal or the like in a single integrated piece. As such, there is no need for the doorknob in this example to rotate, but rather it serves more as a handhold device. Each of the pair of inner shaft buttons 8 include a narrower, threaded end portion 81.

Latch sleeve 16 includes an opening 18 sized to allow the latch 15 to slide in and out of the opening. The latch 15 includes a latch channel 27 sized to receive the latch compression spring 14 and the latch slider 13. Each of the handles 1 include a first channel 20 sized to fit one of the compression springs 4, which is in turn inserted on an outside end into one of the pushbuttons 3. Each pushbutton 3 includes a threaded inner channel 33 for threading on to one of the threaded end portions 81. One of the compression springs 4 is thereby captured within a channel 20 and held in place by the inner channel 33 screwed onto the threaded end portion 81 which is inserted along a center axis 92 within the channel 20. Each handle 1 includes, for example, screw holes 22 to allow mounting onto a doorframe using screws 7. Each handle 1 includes a second channel 24 sized to allow insertion of one of the inner shaft buttons 8. Each handle 1 may comprise a standard doorknob or standard lever door opener shape, for example.

The components 1-16 are assembled together within a doorframe as follows. The latch compression spring 14 and the latch slider 13 are inserted into the latch 15. A light coating of siliconized grease is applied to the latch slider 13 prior to installation. The retaining ring 12 is connected to secure the compression spring 14 in place with the latch slider 13. One of the coiled spring pins 11 is pressed through the latch slider 13 with the master connector 10 in place such that the master connector 10 and latch slider 13 freely rotate. Four of the coiled spring pins 11 are pressed into four of the connectors 9 while held aligned with connecting holes of the master connector 10 and two of the inner shaft buttons 8 so as to attach all of these components together into right and left sides. The connectors and inner shaft buttons are assembled to ensure free play between all moving joints. A light coating of low viscosity oil may advantageously be applied to moving joints. To further allow freedom of movement, a light coating of silicone may be applied to each inner shaft button 8.

The pair of pushbuttons 3 are inserted into each handle first channel 20. A pair of female threaded rods 6 are screwed onto each pair of set screws 5 using thread locker material applied to the setscrews 5. A pair of the first compression springs 4 are opened until they can fit down over the inner shaft button 8 without substantial interference. One of the compression springs 4 is inserted into the first channel 20 of each handle 1 and held in place by screwing a cap 3 onto a threaded end portion 81.

Figure 2:
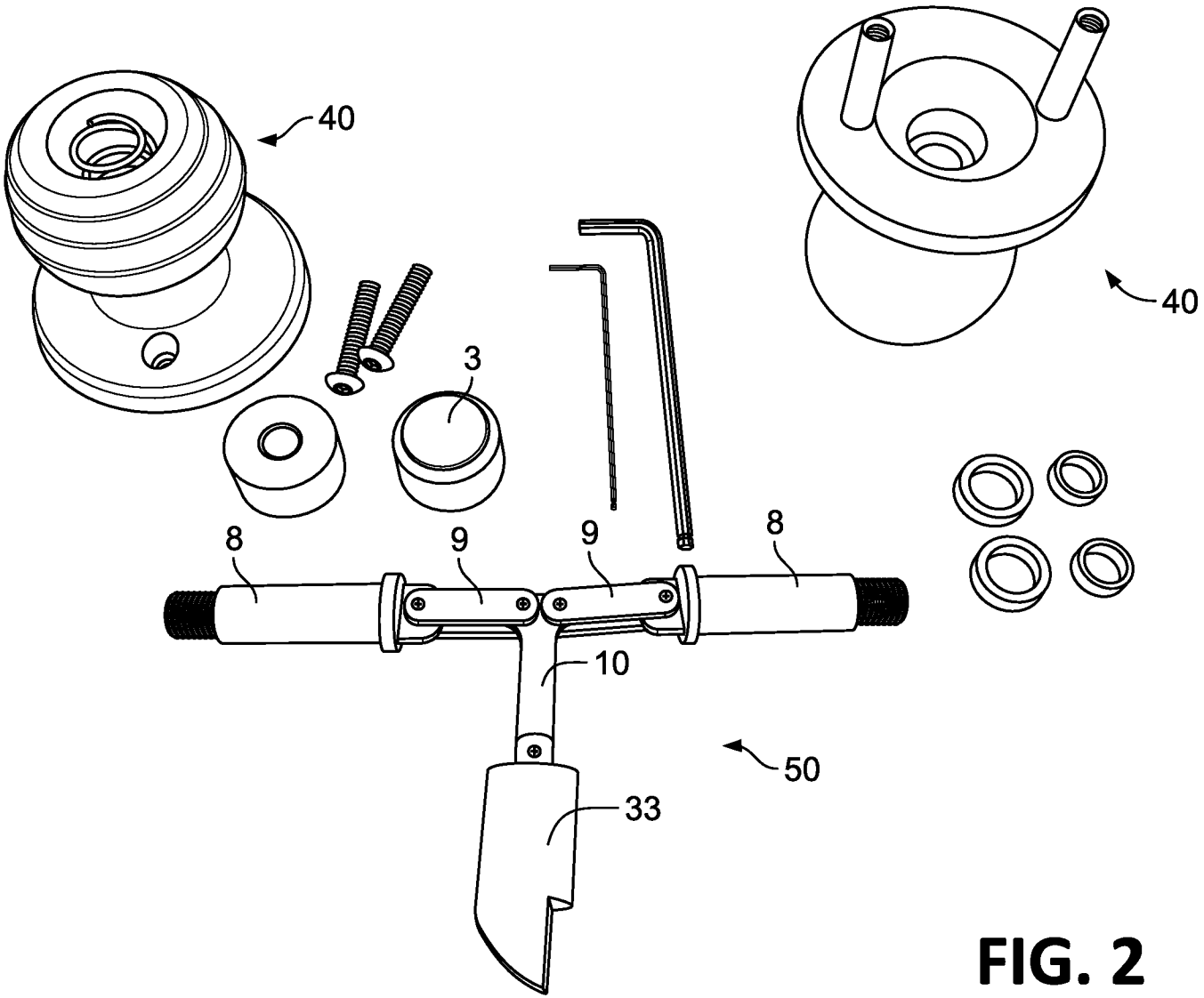
FIG. 2 schematically shows preassembled subassemblies of one example of a safety door latch system.
Figure 3:
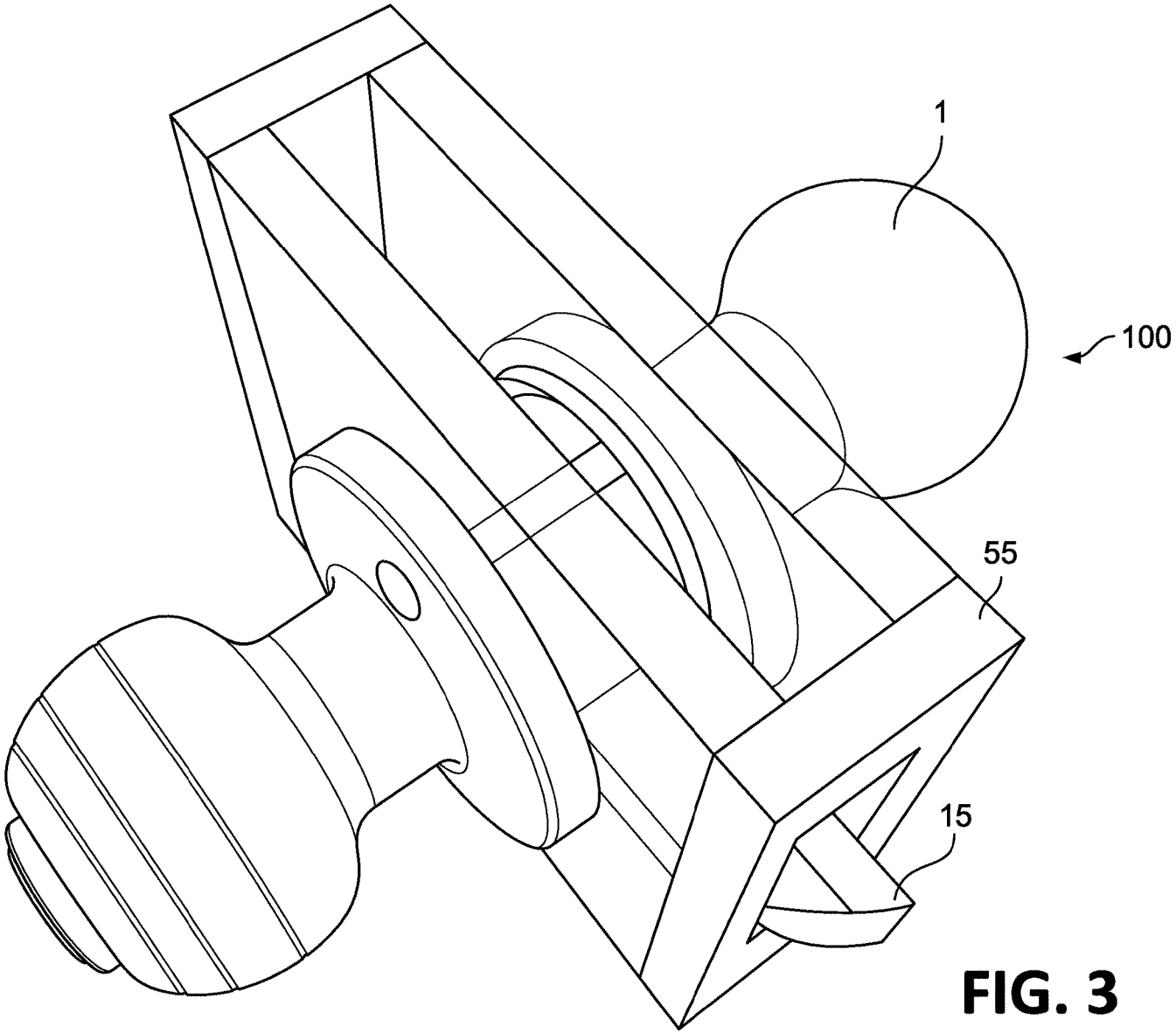
FIG. 3 schematically shows one example of a safety door latch system as assembled into a doorframe facsimile.

Referring now jointly to FIG. 2 and FIG. 3, installation of component parts of one example of the door safety latch are schematically illustrated. The door safety latch may be packaged as a kit with subassemblies wherein each of the handles 1 are assembled with the first compression springs 4 in place as well as the pair of female threaded rods 6 screwed onto each pair of set screws 5 to form a pair of handle subassemblies 40. Further, the latch 15, latch slider 13, retaining ring 12, master connector 10, plurality of connectors 9 and inner shaft buttons 8 may all be connected as a flexible latch sleeve subassembly 50. These subassemblies may be then installed into a doorframe by assembling the flexible latch sleeve subassembly 50 into a door while sliding the latch sleeve into the doorjamb side of the door. The latch sleeve is loosely attached to the door. A handle 1 with threaded rods 6 attached as standoffs to one side of one may also be loosely attached. One of the pushbuttons 3 is screwed onto a compression spring 4 that is held within each handle 1. In one example, hex nuts and hex keys may be used to help hold the pushbuttons in place. The opposing handle may then be slid into place and screwed to opposite handle. Screws may be kept loose until the final assembly is finished. Using setscrews or the like to fix the various components such as the pushbuttons and latch in place, the second push button 3 may then be screwed onto the compression spring 4 and tightened, as with an Allen wrench. It is optional to attach one handle to the flexible latch sleeve subassembly 50 before positioning it into the doorframe 55. Once the assemblies are in place the screws on the latch sleeve maybe tightened. The handles may be adjusted towards the edge of the door before tightening the components so that the latch is fully extended, but no springs are being pressed. The screws can then be tightened. The installation can then be tested and positioned as needed.

Figure 4:
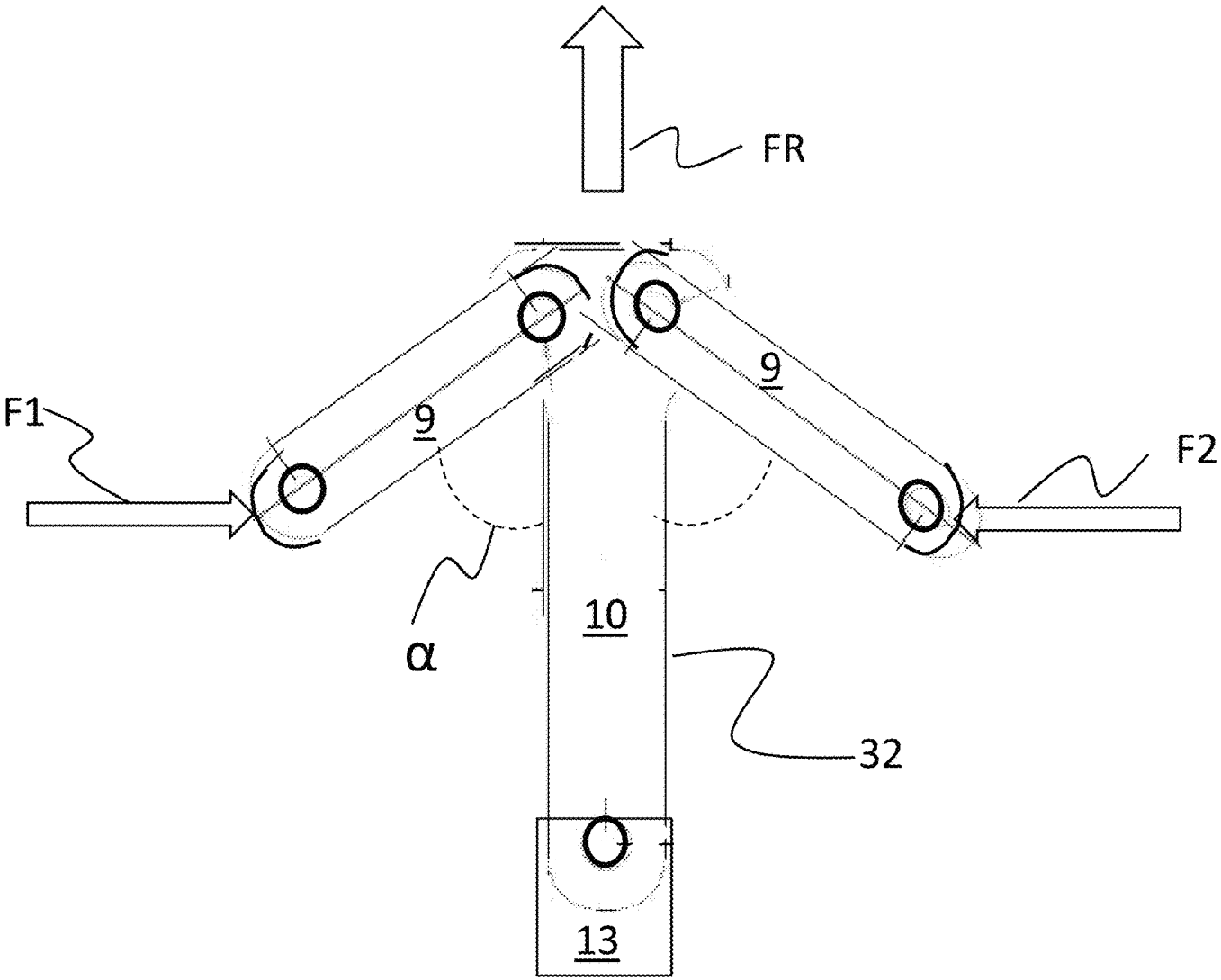
FIG. 4 schematically shows a force diagram illustrating the operation of internal mechanisms of the safety door latch system.

Referring now to FIG. 4, a force diagram illustrating the operation of internal mechanisms of the safety door latch is schematically shown. The plurality of connectors 9 are connected to the master connector 10 as described above. The master connector 10, in turn, is connected to the latch slider 13. The other connected components, such as the latch 15 are not shown in this drawing for the sake of simplicity and explaining the operational mechanism, however, it should be assumed that they are also attached as described above. Note that, when assembled inside a doorframe, the plurality of connectors 9 are angled inwardly to form an acute angle $\alpha$ with respect to the linear edges 32 of the master connector 10. In other words, assuming a vertical line parallel to the linear edges 32, all of the plurality of connectors 9, when properly assembled, would be angled inwardly toward that vertical line so as to translate force F1 or F2 to produce a release force FR in a direction sufficient to release the latch 15. In a locked mode, no inwardly directed force F1 or F2 is applied to either pushbutton. In the locked mode, all of the components are biased by the various compression springs such that the latch 15 protrudes from the latch sleeve 16, holding the door locked.

When in operation, an inwardly directed force F1 or F2 is applied to one of the pushbuttons 3. The applied force is mechanically translated to one of the pairs of connectors 9 thereby creating a release force component FR causing the plurality of connectors 9, which are attached to the master connector 10, to pull the master connector 10 in a linear direction, which in turn draws the latch slider 13 and latch 15 into the latch sleeve 16, thereby releasing the door latch and allowing the door to be opened.

Figure 5:
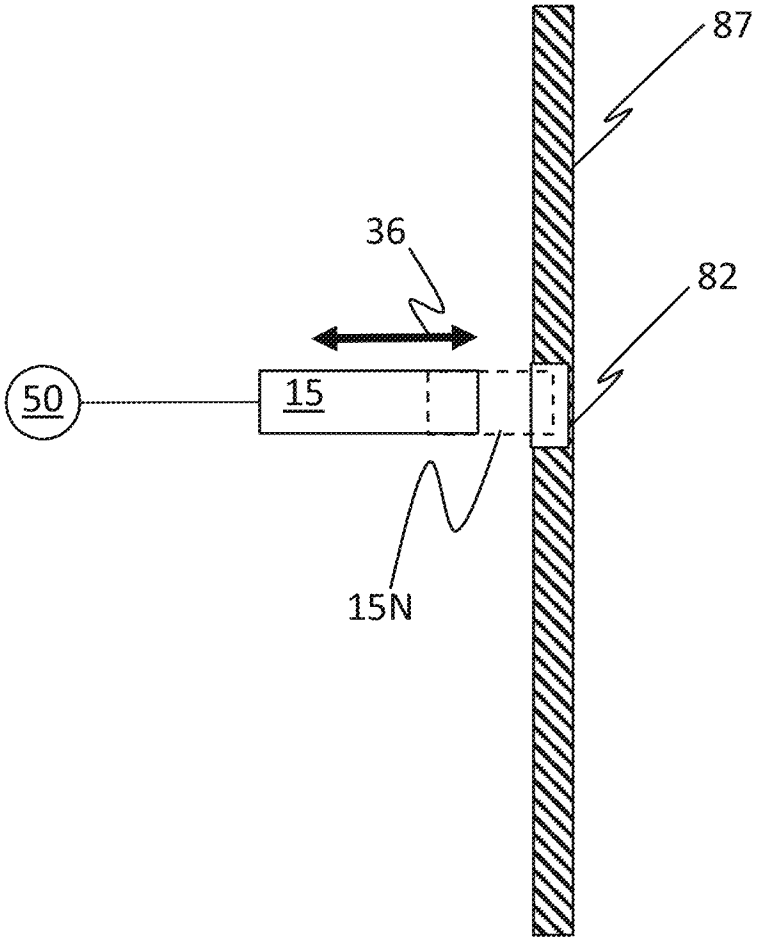
FIG. 5 schematically illustrates the operation of a safety door latch when deployed in connection with a door jamb.

Referring now to FIG. 5, the operation of a safety door latch when deployed in connection with a door jamb is schematically illustrated. There shown in a cutaway cross-section is a doorjamb 87 having a latch notch 82 recessed therein in the usual manner. In operation, as the activation assembly is forced in a direction moving in or out of the page, the latch 15 is withdrawn from the latch notch 82. When force is removed from either pushbutton, flexible latch sleeve subassembly 50 returns to its normal biased state and the latch 15 returns to a latched position indicated by 15N. In this way, the latch 15 is translated in and out of latched position as designated by double arrow 36. Thus, applying force to either pushbutton will unlatch the door and allow it to be pushed or pulled open as the case may be.

Figure 6:
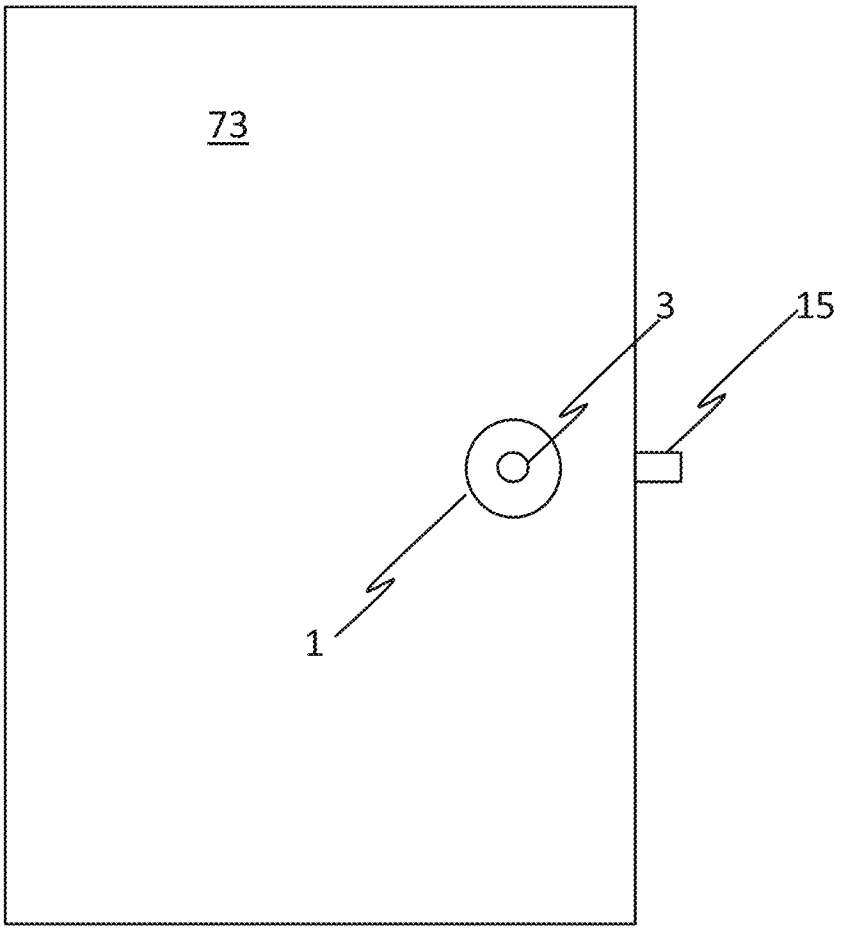
FIG. 6 schematically illustrates positioning of one side panel of a door with a safety door latch installed.

Referring now to FIG. 6, positioning of one side of a door with the safety door latch installed is schematically illustrated. Here shown handle 1 housing pushbutton 3 is mounted in a door 73. The latch 15 is shown in a normally latched position. The handle 1 is also mounted to the door for the purpose of pulling the door open or pushing the door when the latch 15 is disengaged by pushing button 3. Of course, if the door is hinged such that it is opened by pushing, a handle is not necessary. Those skilled in the art will also recognize that it is not necessary to shape the handle as shown in the figures, but alternative shapes such as elongated handles, levers and the like may also be used.

In one useful application, it is especially advantageous to be able to interchange different springs with increasingly stronger spring constants as the child increases with age. As has been demonstrated, as children grow older thumb strength increases (see, for example, Table 3, H. M. Molenaar PhD, Growth Diagrams for Individual Finger Strength in Children Measured with the RIHM, Clin Orthop Relat Res (2011) 469:868-876). This feature would allow selection of a pair of springs for installing in the safety door latch that may, for example, restrict entrance by younger children while still allowing entrance by older children or elderly adults if desired.

Figure 7:
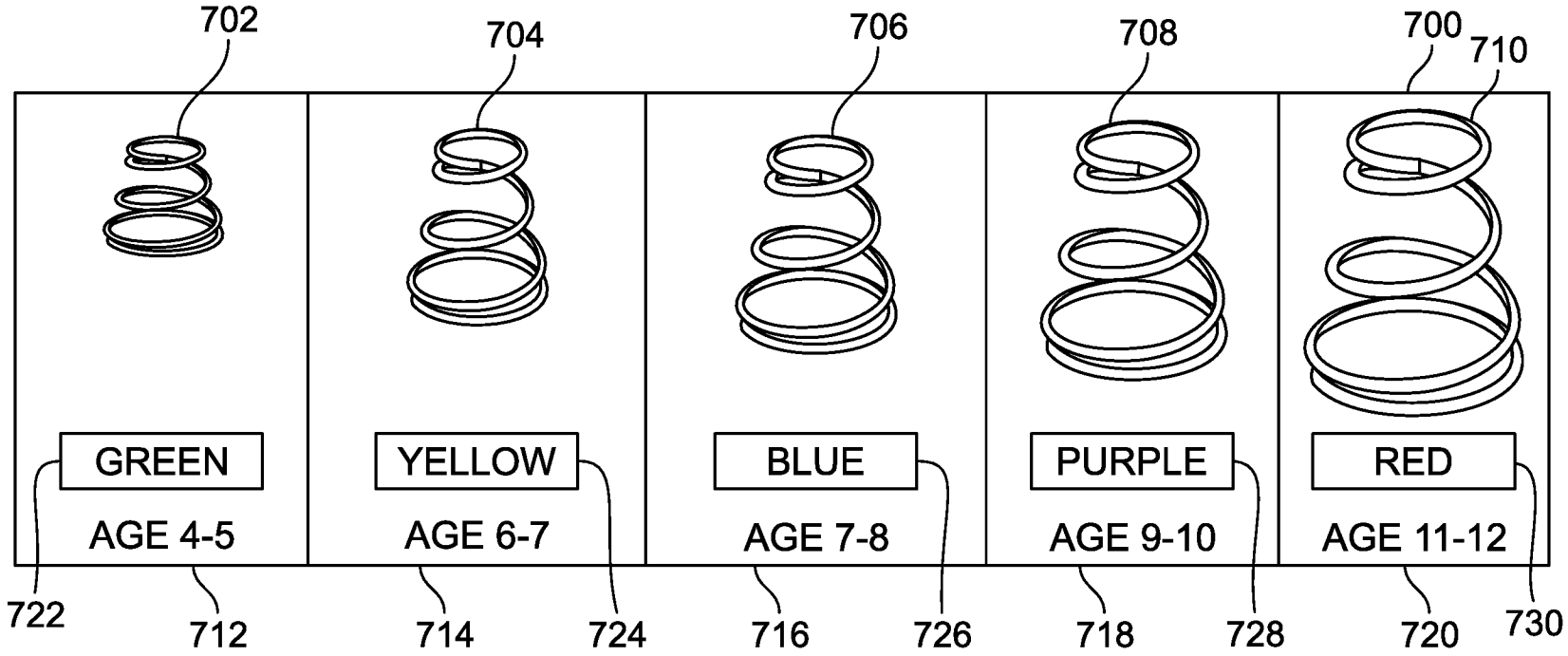
FIG. 7 schematically illustrates a segmented box containing up a plurality of springs of various tensions is shown.

Referring now to FIG. 7, a segmented box containing up a plurality of springs of various tensions is shown. Spring tension may be measured as a function of Newtons per meter which is equal and to the spring constant, k. A segmented box 700 includes a plurality of springs 702, 704, 706, 708 and 710. Each of the plurality of springs has a different spring constant k proportional or equivalent to the average thumb opposition strength of children of various ages. In the preferred embodiment compression springs proportional to thumb opposition strengths for various ages are provided and identified according to age ranges. The segmented box 700 includes a plurality of segmented areas 712, 714, 716, 718 and 720, where each segmented area may contain 2 or more springs having the same spring constant. Each segmented area may also include a legend indicating an age or age range. The legends are intended for guiding the user in selecting springs having a spring constant exceeding the thumb strength of a child or other person to prevent that child or other person from opening the safety door latch.

Besides segmenting the varying springs in the segmented box with the age indicia indicated in the same segment with each spring, each spring may also be labeled or color-coded in accordance with the value of its spring constant k. The color hundred coding may also be applied to each segment of the container. For example, color coding may include a series such as green 722, yellow 724, blue 726, purple 728, and red 730, where the series increases in k constant value from green to red.

On order to exchange springs to increase or decrease the strength needed to activate the safety door latch, caps 3 must be unscrewed from the pair of threaded and portions 81, the current spring can then be removed and replaced with a spring upper different tension. A new compression springs may then be inserted into the first channel 20 of each handle 1 and held in place by screwing a cap 3 onto a threaded end portion 81. This is repeated with the matching compression springe for the other door handle to complete the safety latch.

In one useful example, disclosed herein is a child safety door latch system including a set of interchangeable pushbutton compression springs, including compression springs of varying tensions, wherein the varying tensions are proportional to selected values of thumb strength. A pair of compression springs is selected to be proportional to the thumb strength of a predetermined age group from the set of interchangeable pushbutton compression springs. A set of pushbuttons each includes a threaded inner channel. A pair of inner shaft buttons includes a threaded end portion for threading on to one of the pushbutton threaded inner channels and capturing one of the selected pair within one of the inner shaft buttons. A plurality of connectors, a latch slider and a latch compression spring are also part of the system. A pair of handles where each handle includes a first channel sized to contain one of the selected pair of compression springs and the pushbutton, each handle also includes a second channel, aligned with the first channel, sized to allow insertion of one of the pair inner shaft buttons at the threaded end portion, where one of the selected pair of compression springs is captured in a different one of the pair of handles, between a one of the pair inner shaft buttons at the threaded end and one of the pushbuttons. Further, each handle includes mounting devices to allow mounting onto a doorframe. A latch includes a first channel sized to receive the latch compression spring and the latch slider. A master connector includes a pair of opposing linear edges, where the master connector is coupled at a first end to the plurality of connectors and at a second end to the latch slider, and the plurality of connectors is angled inwardly to form an acute angle with respect to the linear edges of the master connector. In a locked mode, the selected pair of compression springs cooperate with the latch compression spring such that the latch protrudes from the latch sleeve, holding the door locked.

In another example, each of the handles comprise a material selected from the group consisting of nylon, plastic, metal and combinations thereof.

In another example, an inwardly directed force applied to one of the pushbuttons mechanically translates the plurality of connectors thereby creating a release force component causing the plurality of connectors to pull the master connector in a retraction direction, which in turn draws the latch slider and latch into the latch sleeve, thereby releasing the door latch and allowing the door to be opened.

In another example, the latch slider includes a second channel for containing the latch compression spring, where the latch compression spring is held at a first end in the second channel by a retaining ring and where the latch compression spring is contained at a second end within the first channel.

In another example, the set of interchangeable pushbutton compression springs are color coded to designate different age ranges of use.

In yet another example, a safety latch system kit includes a set of interchangeable pushbutton compression springs of varying tensions, wherein the varying tensions are proportional to selected values of thumb strength of a predetermined age group. A set of pushbuttons is included, wherein each pushbutton includes a threaded inner channel. A pair of inner shaft buttons, each of the pair of inner shaft buttons includes a threaded end portion adapted for threading on to one of the pushbutton threaded inner channels and capturing one of the selected pair within one of the inner shaft buttons. A plurality of connectors, a latch slider, and a latch compression spring also included. A pair of handles, each handle includes a first channel sized to contain one of the selected pair of compression springs and the pushbutton, each handle also includes a second channel, aligned with the first channel, sized to allow insertion of one of the pair inner shaft buttons at the threaded end portion, where one of the selected pair of compression springs is adapted to be captured in a different one of the pair of handles, between one of the pair inner shaft buttons at the threaded end and one of the pushbuttons. A latch includes a first channel sized to receive the latch compression spring and the latch slider. A master connector includes a pair of opposing linear edges, where the master connector is adapted to be coupled at a first end to the plurality of connectors and at a second end to the latch slider, and where the plurality of connectors is angled inwardly to form an acute angle with respect to the linear edges of the master connector. A latch sleeve including an opening sized to allow the latch to slide in and out of the opening. In a locked mode, the selected pair of compression springs cooperate with the latch compression spring such that the latch protrudes from the latch sleeve, holding the door locked.

In one example, each of the handles comprise a material selected from the group consisting of nylon, plastic, metal and combinations thereof.

In one example, an inwardly directed force applied to one of the pushbuttons mechanically translates the plurality of connectors thereby creating a release force component causing the plurality of connectors to pull the master connector in a retraction direction, which in turn draws the latch slider and latch into the latch sleeve, thereby releasing the door latch and allowing the door to be opened.

In one example, the latch slider includes a second channel for containing the latch compression spring, where the latch compression spring is held at a first end in the second channel by a retaining ring and where the latch compression spring is contained at a second end within the first channel.

In one example, the set of interchangeable pushbutton compression springs are color coded to designate different age ranges of use.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. A child safety door latch system comprising:

a right handle including,
- a right pushbutton,
- a right threaded inner channel in the right pushbutton,
- a right handle channel,
- a right spring inserted into the right handle channel,
- a right inner shaft including a threaded end portion inserted through the first right handle channel, through the right spring and screwed into the right threaded inner channel to form a right handle subassembly;

a left handle including,
- a left pushbutton,
- a left threaded inner channel in the left pushbutton,
- a left handle channel,
- a left spring inserted into the left handle channel,
- a left inner shaft including a threaded end portion inserted through the first left handle channel, through the left spring and screwed into the left threaded inner channel to form a left handle subassembly;

a master connector connected to the right hand subassembly and the left hand subassembly;

a latch slider attached to the master connector;

a latch spring;

a latch;

a latch channel inside the latch wherein the latch channel slidingly contains the latch spring and the latch slider; and a latch sleeve adapted to receive the latch.

2. A child safety door latch system comprising:

a pair of springs including a right spring and a left spring selected from the group consisting of a first pair of springs each having a spring rate proportional to a thumb opposition strength for children aged 4-5, a second pair of springs each having a spring rate proportional to a thumb opposition strength for children aged 6-7, a third pair of springs each having a spring rate proportional to a thumb opposition strength for children aged 7-8, a fourth pair of springs each having a spring rate proportional to a thumb opposition strength for children aged 9-10, and a fifth pair of springs each having a spring rate proportional to a thumb opposition strength for children aged 11-12;

a right handle including, a right pushbutton, a right threaded inner channel in the right pushbutton, a right handle channel, a right spring inserted into the right handle channel, a right inner shaft including a threaded end portion inserted through the first right handle channel, through the right spring and screwed into the right threaded inner channel to form a right handle subassembly;

a left handle including, a left pushbutton, a left threaded inner channel in the left pushbutton, a left handle channel, a left spring inserted into the left handle channel, a left inner shaft including a threaded end portion inserted through the first left handle channel, through the left spring and screwed into the left threaded inner channel to form a left handle subassembly;

a master connector attached to the right hand subassembly and the left hand subassembly;

a latch slider attached to the master connector;

a latch spring;

a latch;

a latch channel inside the latch, wherein the latch channel slidingly contains the latch spring and the latch slider; and a latch sleeve adapted to receive the latch.

* * * * *